US007628140B2

(12) United States Patent
Trubnikov

(10) Patent No.: US 7,628,140 B2
(45) Date of Patent: Dec. 8, 2009

(54) HIGH-PRESSURE PUMP OR INJECTOR PLUG OR GUIDE WITH DECOUPLED SEALING LAND

(75) Inventor: Timur T. Trubnikov, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 103 days.

(21) Appl. No.: 11/863,099

(22) Filed: Sep. 27, 2007

(65) Prior Publication Data

US 2009/0084354 A1 Apr. 2, 2009

(51) Int. Cl.
*F02M 59/46* (2006.01)
*F02M 37/00* (2006.01)

(52) U.S. Cl. ..... 123/467; 123/510

(58) Field of Classification Search ..... 123/510, 123/467

See application file for complete search history.

(56) References Cited

U.S. PATENT DOCUMENTS 0,399,565 A 3/1889 Rueff
2,264,136 A 11/1941 Karlberg
2,790,460 A 4/1957 Radd
2,847,183 A 8/1958 Buri
2,939,479 A 6/1960 Gilmore
3,726,612 A * 4/1973 Greene, Jr. ..... 417/454
3,896,845 A * 7/1975 Parker ..... 137/493.3
4,026,322 A * 5/1977 Thomas ..... 137/512
4,064,907 A * 12/1977 Billington et al. ..... 137/614.2
4,172,465 A * 10/1979 Dashner ..... 137/533.27
4,568,062 A 2/1986 Regitz et al.
4,627,571 A * 12/1986 Kato et al. ..... 239/90
4,628,957 A * 12/1986 Hofer et al. ..... 137/493.3
4,648,369 A * 3/1987 Wannenwetsch ..... 123/467
4,674,688 A * 6/1987 Kanesaka ..... 239/533.8
4,692,102 A * 9/1987 Hafele et al. ..... 417/296
4,812,105 A 3/1989 Heymann
4,834,134 A * 5/1989 Asami et al. ..... 137/493.3
4,892,465 A * 1/1990 Born et al. ..... 417/218
4,964,391 A * 10/1990 Hoover ..... 123/510
5,232,014 A 8/1993 Hiltebrand
5,288,087 A 2/1994 Bertoldo
5,375,812 A 12/1994 Kent
5,411,050 A * 5/1995 Saville ..... 137/101
5,553,902 A 9/1996 Powers
5,623,910 A * 4/1997 Riggle ..... 123/510
5,634,444 A * 6/1997 Matsuki et al. ..... 123/306
5,692,476 A 12/1997 Egler et al.

(Continued)

FOREIGN PATENT DOCUMENTS

DE 884437 7/1953

(Continued)

*Primary Examiner*—Thomas N Moulis
(74) *Attorney, Agent, or Firm*—Leydig, Voit & Mayer Ltd; Carl E. Myers

(57) ABSTRACT

A unitary high pressure seal provides a fluid seal against multiple surfaces, at least one of which is static and one of which is dynamically loaded. The seal includes a seal body and separated load and sealing lands. The load land interfaces with the static surface, e.g., a valve assembly barrel, to seal the body to that surface, whereas the sealing land dynamically provides a seal against a variably positioned surface, e.g., a valve head surface. In this manner, when the valve is closed, the load land is not affected by the dynamic loads on the sealing land, and leakage at the static surface is thus minimized.

20 Claims, 5 Drawing Sheets

U.S. PATENT DOCUMENTS

| | | | | |
|---|---|---|---|---|
| 5,749,394 | A | 5/1998 | Boehmer et al. | |
| 5,832,954 | A * | 11/1998 | Shafer | 137/543.15 |
| 5,839,414 | A * | 11/1998 | Klinger et al. | 123/467 |
| 5,950,669 | A * | 9/1999 | Fehlmann et al. | 137/493.3 |
| 6,045,008 | A | 4/2000 | Fernandez et al. | |
| 6,244,348 | B1 | 6/2001 | Gariepy et al. | |
| 6,336,329 | B1 | 1/2002 | Adler et al. | |
| 7,219,495 | B2 | 5/2007 | Ludsteck et al. | |
| 7,451,780 | B1 * | 11/2008 | Trimble | 137/493.4 |
| 2002/0101040 | A1 * | 8/2002 | Russell | 277/609 |
| 2004/0021122 | A1 * | 2/2004 | McArthy et al. | 251/337 |

FOREIGN PATENT DOCUMENTS

| | | |
|---|---|---|
| DE | 19822671 | 11/1999 |
| EP | 0678668 | 10/1995 |
| EP | 1223338 | 7/2002 |
| EP | 1653076 | 5/2006 |
| FR | 2498723 | 7/1982 |
| GB | 2155544 | 9/1985 |
| WO | 9212341 | 7/1992 |
| WO | 03087645 | 10/2003 |

* cited by examiner

HIGH-PRESSURE PUMP OR INJECTOR PLUG OR GUIDE WITH DECOUPLED SEALING LAND

1. TECHNICAL FIELD

This patent disclosure relates generally to engine fuel system sealing and, more particularly to a sealing structure for simultaneously sealing both a static surface and a dynamically loaded surface.

BACKGROUND

The pressures in diesel engine fuel systems can often be very high, and are often on the order of 10,000-30,000 PSI, compared with no more than about 60 PSI in a gasoline engine fuel system. The pressurized fuel exerts strong forces on many components of such systems, including the system seals in particular. For purposes of manufacturability, maintenance, expansion, etc., diesel fuel systems such as pumps and injector systems include openings that are sealed by plugs or partially sealed by valve guides.

In many cases, however, the plug or guide must seal again both a static surface and a dynamically loaded surface as the fuel pressure and system operations change. In such environments, the dynamic forces on one portion of the seal tend to pry up or "unzip" the static seal, leading to leakage and system failure. Although there have been attempts to solve this problem through increased tightening of seals and other traditional measures, leakage problems due to cycling-induced leakage continue to occur. While it is possible to increase the hardness of seals, this can lead to fracturing under pressure.

Although some implementations of the examples disclosed herein will operate to solve the noted problems, it will be appreciated that resolving such shortcomings is not a limitation or essential feature of the present innovation. This background discussion is presented for the reader's convenience, and is not intended to identify relevant prior art or to conclusively characterize any art. The teachings of the prior art will be best understood by reference to the prior art itself, and the foregoing discussion is not intended to extend the teachings of the prior art in any way. Any inconsistency in this characterization should be resolved in favor of actual prior art, not this background section.

BRIEF SUMMARY OF THE INVENTION

The disclosed principles pertain to a high pressure seal for providing a fluid seal against multiple surfaces, wherein at least one of the surfaces is a static surface and at least one of the surfaces is a dynamically loaded surface. In one aspect, the seal comprises a seal body with a load land on the seal body for sealing against a first surface. The seal body further includes in this aspect a sealing land on the seal body for sealing against a second surface. The first surface is a static surface and the second surfaces is a dynamically loaded surface.

DETAILED DESCRIPTION

This disclosure relates to a sealing system that is advantageous in any pressurized system but particularly for use in high-pressure and/or high-stress environments where forces exerted on one sealing surface may undesirably affect another sealing surface. Although the disclosed examples pertain to metallic seals and structures, it will be appreciated that the disclosed principles may also be beneficially applied to other types of materials.

Figure 1:
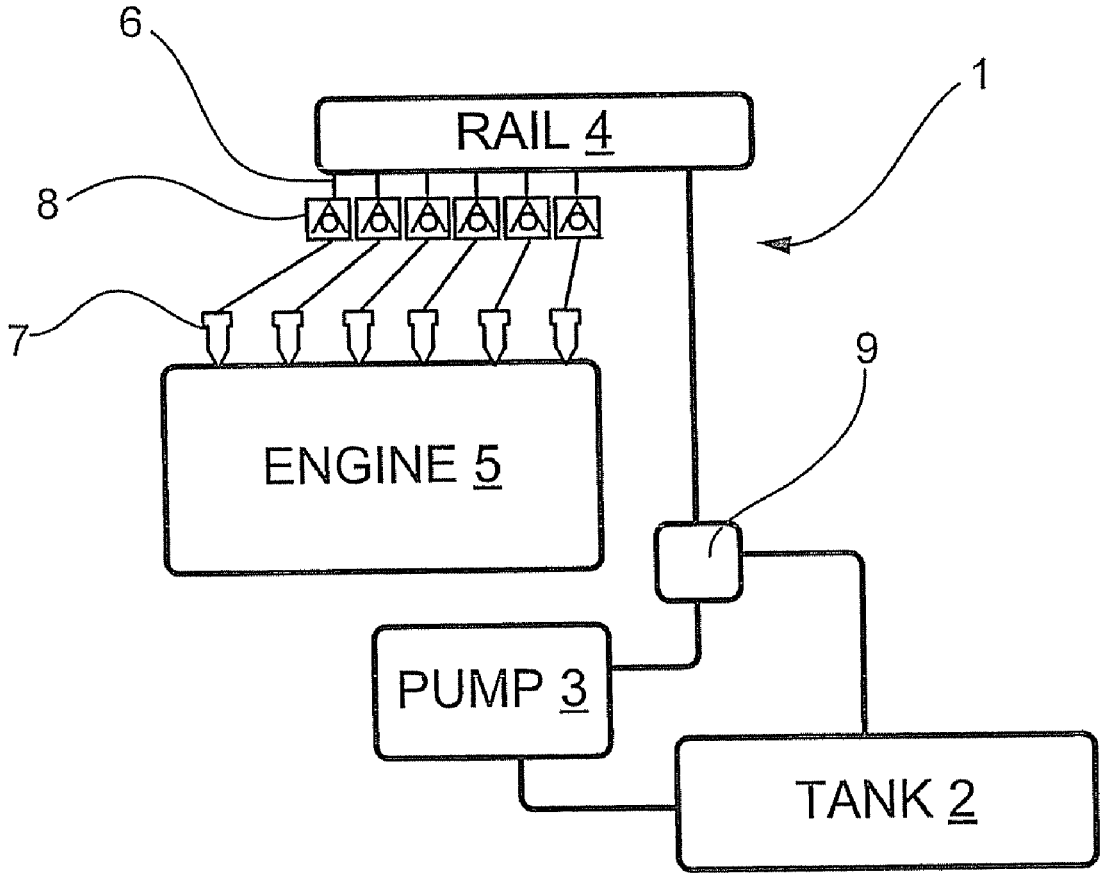
FIG. 1 is a perspective cross-sectional view of a fuel system check valve assembly showing multiple sealing surfaces.

One exemplary environment is a diesel fuel delivery system as shown in FIG. 1. As shown, the fuel delivery system 1 includes a fuel tank 2 linked to a fuel pump 3. The fuel pump 3 receives fuel from the tank 2 and pressurizes it for delivery to the engine 5. In a diesel engine, the fuel pressure generated by the pump 3 may be on the order of 20-30,000 PSI to enhance fuel atomization. The pump may be driven from the vehicle engine 5 or may be electrically driven.

The output of the pump 3 is provided under pressure to a fuel rail 4. The fuel rail 4 provides reservoir of pressurized fuel for feeding the engine 5. Given the large volume of the rail 4, any pressure perturbations caused by the removal of fuel from the rail 4 during injection will be moderated so as not to substantially affect the fuel delivery to other cylinders.

A pressure regulating valve 9 ensures that the rail 4 is not over-pressurized. To the extent that the pump 3 pressure exceeds a predetermined desired level, excess fuel may be shunted back to the tank 2 from the pressure regulating valve 9 via a shunt line.

A number of fuel injector inlets 6 feed off of the rail 4 to provide fuel to the injectors 7 via respective check valves 8. The check valves 8 may be actuated, e.g., via a piezo electric stack, to open at a given time, while the injector valves 7 may be pressure-actuated valve to open upon the introduction into the injector 7 of pressurized fuel. Within a check valve 8, a valve guide, valve stem, and valve barrel are subjected to high stresses through repeated injection cycles.

Figure 2:
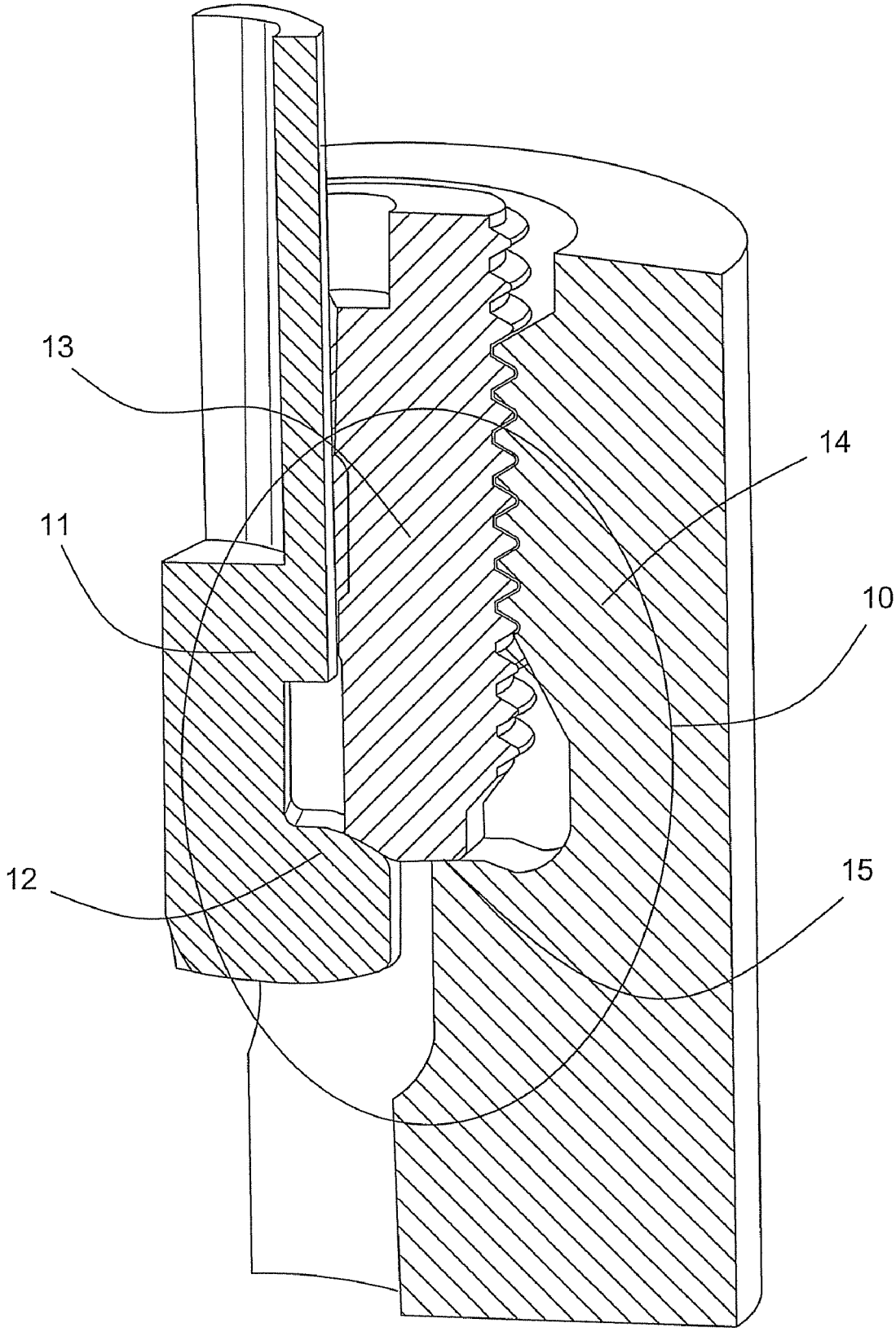
FIG. 2 is a perspective cross-sectional view of a fuel system check valve assembly showing multiple sealing surfaces.

Referring to FIG. 2, a perspective cross-sectional view of a fuel system check valve assembly is shown. The check valve assembly 10 comprises a valve stem 11 having a sealing surface 12, and a guide 13, as well as a barrel 14. In operation, the guide 13 is threaded into the barrel 14 and acts to guide the stem 11 during operation. In order to properly control the flow of high pressure fuel from the rail 4 to the injector 7, the valve guide 13 seals the valve at the valve seat 12 and also at a sealing juncture 15 between the barrel 14 and the guide 13.

It will be appreciated that as the valve assembly 10 is actuated during engine operation, the inlet check valve seat 12 is cycled (loaded and unloaded) repeatedly. Indeed, in the case of a four-stroke engine, the injector (via the check valve 8) is actuated at every other revolution of the crankshaft, such that the valve seat 12 is cycled at a rate equal to half of the engine RPM. Thus, for an engine running four several hours a day at an average RPM of 3000, the valve seat 12 will be loaded and unloaded about 360,000 times.

This repeated stress may affect the structure of the individual valve components, but more importantly, the effects of repeated stresses between components can become substantial. With respect to the valve seat, the sealing interface 15 between the barrel 14 and the valve guide 13 can be eventually peeled open or "unzipped" by the repeated stressing at the nearby valve seat 12. Once this happens, the valve assembly 10 will leak and will then fail to perform properly.

According to the principles described herein, the valve guide 13 is made more robust against this failure mode by decoupling the valve seat 12 from the valve guide 13/barrel 14 interface 15. In particular, as shown in the perspective cross-sectional view of FIG. 3, the lower portion of the valve guide 24 is separated into a guide load land 25 and a guide sealing land 26. The guide load land 25 absorbs the repeated blows from the cycling of the check valve. At the same time the guide sealing land 26 maintains the seal between the valve guide 24 and the barrel 27. The guide load land 25 and the guide sealing land 26 are separated by a space 28 such that the loads applied to the load land 25 are not directly transferred to the sealing land 26, thus enhancing the reliability of the valve assembly.

It will be appreciated that the presence of the separate load land and sealing land do not materially affect the fluid flow through the valve. In the illustrated example, the high pressure fluid is held in the bore 29 of the barrel 14 by the valve when in the closed position. In a plenum 30 on the opposite side of the valve, the fuel is at inlet pressure, much lower than the high pressure of the pumped fuel supply. When the valve opens, the pressure differential forces fuel from the bore 29 into the plenum 30 and out of the assembly via the valve stem 31.

Figure 3:
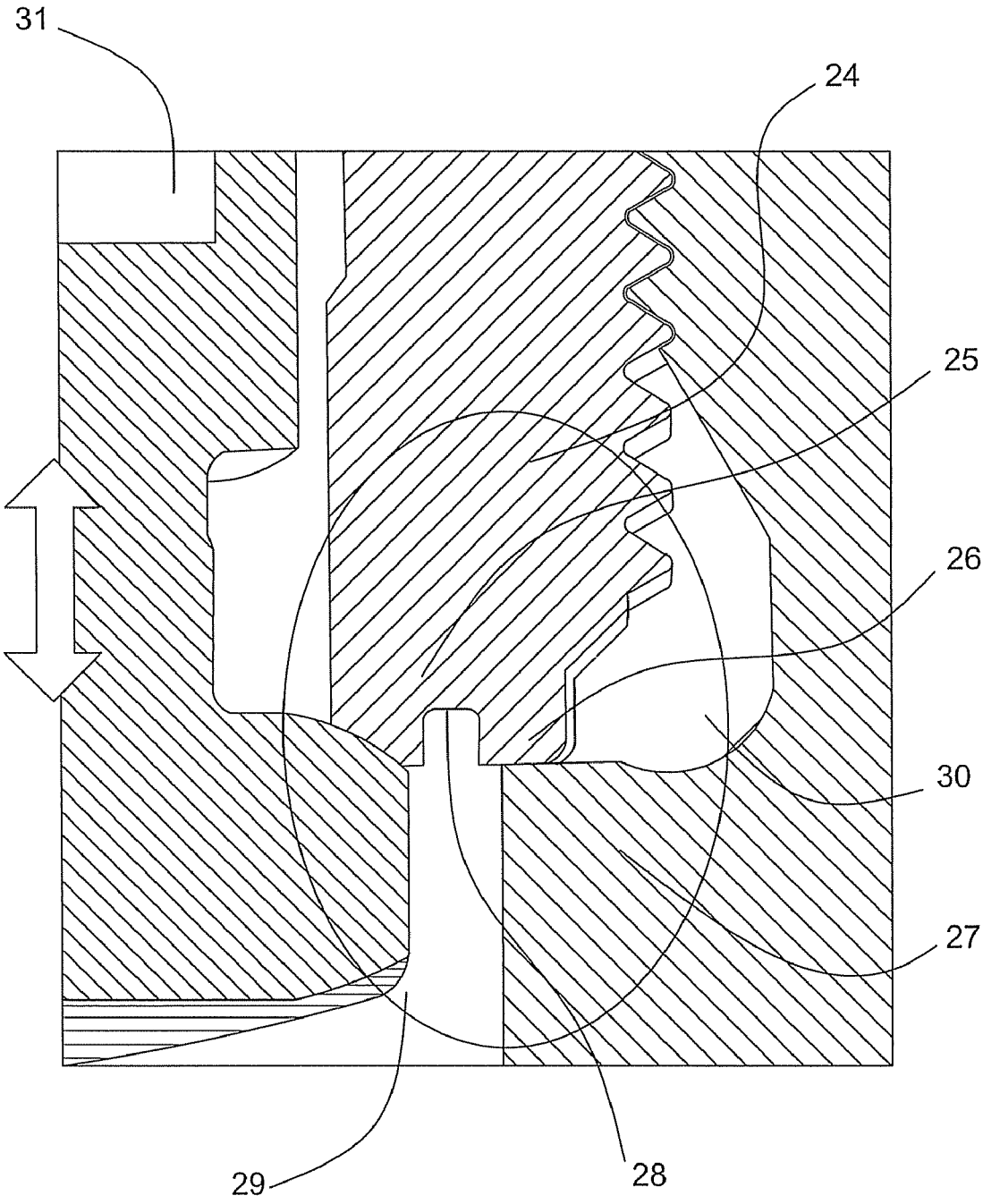
FIG. 3 is a perspective cross-sectional view of a fuel system check valve assembly in keeping with the disclosed principles, showing first and second lands separated by a decoupling groove.

With reference to FIG. 3, it can be seen that the sealing land 26 of the valve guide 24 is tapered to match a mating taper on the valve head. In this manner, the closing force of the valve is angularly amplified. Although the taper angle is not critical, an angle of approximately 45° from horizontal is suitable.

Figure 4:
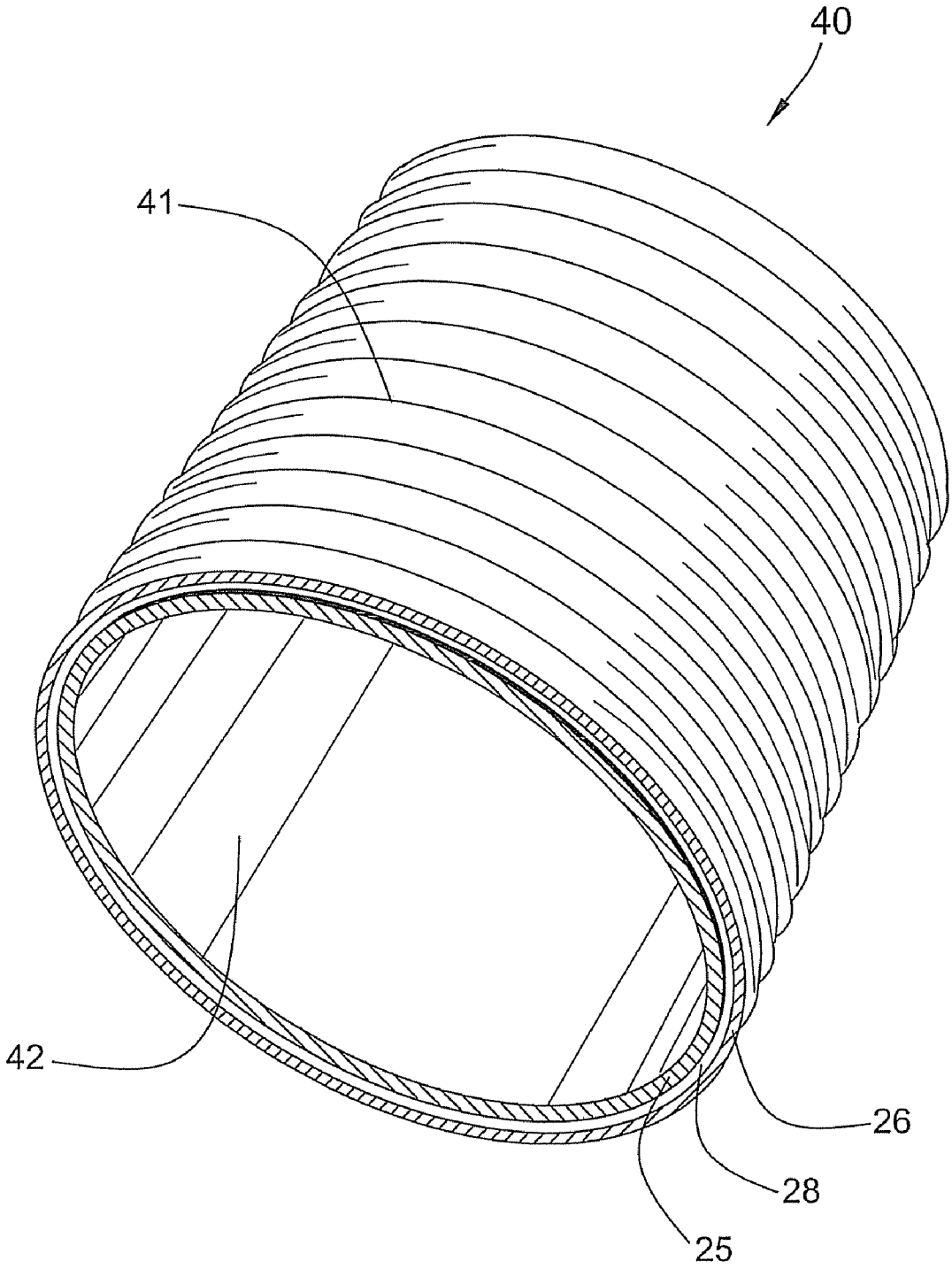
FIG. 4 is a perspective bottom view of a valve guide in keeping with the disclosed principles, showing a load land and a sealing land.

To ensure clarity with respect to the configuration of the guide face, the guide 24 is shown in isolated perspective view in FIG. 4. As can be seen the guide 40 is essentially cylindrical, having a threaded exterior surface 41 and an interior bore 42. The end face of the guide 40 comprises an outer ring, i.e., the valve sealing land 26, and a concentric inner ring, i.e., the valve load land 25. The valve sealing land 25 and valve sealing land 26 are separated by an isolation groove 28. As the guide 40 is threaded into the barrel 14, the valve load land 25 is compressed against a mating surface of the barrel 14.

Although the foregoing examples illustrate the disclosed principles as applied within an injector inlet check valve, the principles are equally applicable in other environments, both within and outside of a fuel delivery system. Within a high pressure fuel delivery system, other locations where the described innovation is beneficial include spill valves, e.g., to shunt pressurized fuel from the pump 3 outlet back to the tank 2. This can become necessary when the pump output exceeds the current fuel demands of the engine 5. Other environments that may benefit from the disclosed improvements include a pump head outlet check plug.

Figure 5:
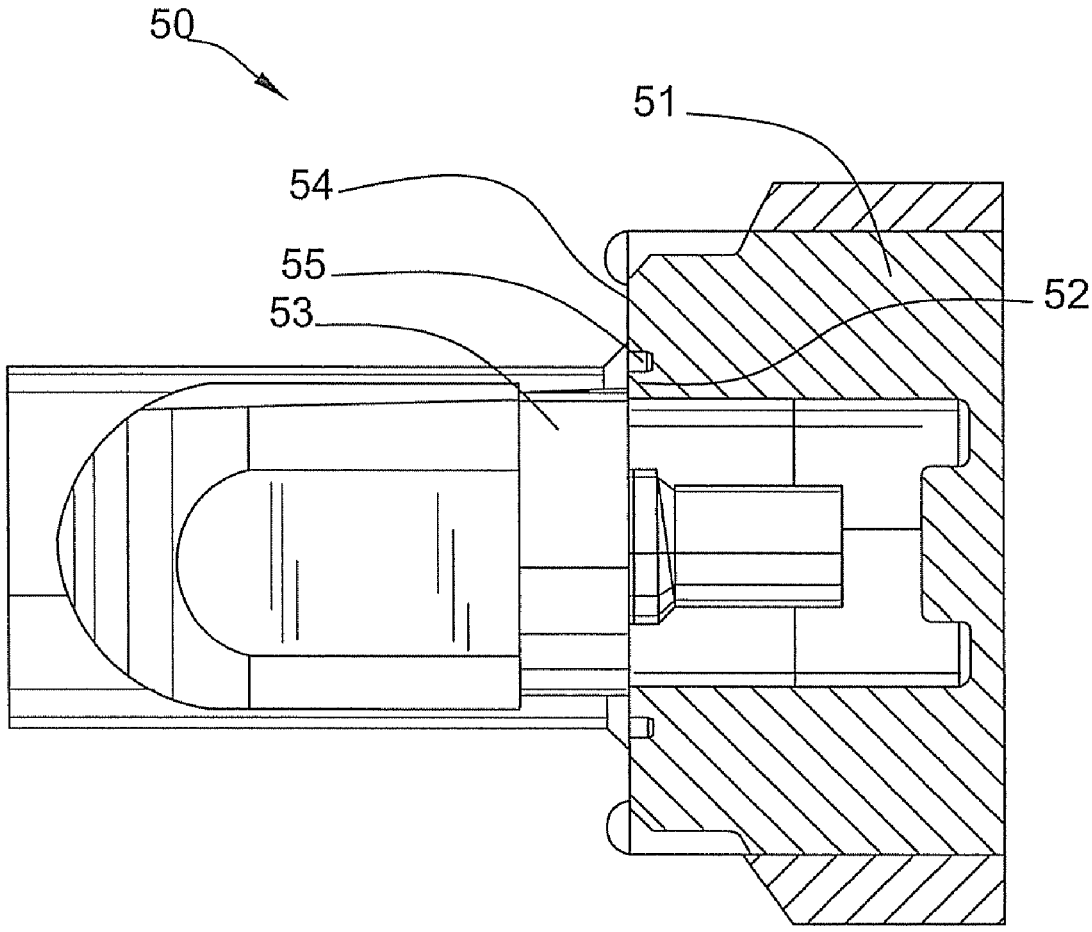
FIG. 5 is a perspective cross-sectional view of a fuel system outlet check plug assembly in keeping with the disclosed principles, showing first and second lands separated by a decoupling groove.

FIG. 5 shows the application of the disclosed principles in the construction of an outlet check plug assembly 50. The outlet check plug assembly 50 includes a plug 51, having a load land 52 disposed against an outlet check body 53. The outlet check plug assembly 50 further includes sealing land 54 for sealing against the pump head (not shown). A decoupling groove 55 separates the load land 52 from the sealing land 54. With this construction, the variable high pressure to which the outlet check is exposed does not affect the sealing between the plug 51 and the pump head.

Typically the valve guide 40 is made of a high strength steel such as 4150 alloy steel (0.05% carbon). For threaded parts such as the illustrated valve guide, the part is typically heat treated to a Rockwell hardness of 40-50 C. Parts with significant wear areas may be treated to a Rockwell hardness of 50-59 C, e.g., 55 C for wear and fatigue resistance. In an embodiment, the part is not fully hardened, i.e., to 60 C, because some amount of residual softness adds ductility and fatigue resistance to avoid fracturing or shattering of the guide under load or impact conditions.

Although as noted above 4150 steel is a good choice of guide material in many applications, other materials may alternatively be employed in the construction of the valve guide 40 depending upon the intended application. For example, many alloy and carbon steels have known properties suitable for the stresses of particular applications with respect to material compatibilities, corrosion resistance, wear, strength, fatigue resistance, and so. For instance, 4140 steel (HRC50-55) and 52100 steel (HRC59 min) plugs and guides may be used if the intended use environment dictates a need for the qualities of these materials.

The various parts of the valve guide 40 may also be differentially hardened. For example, the sealing land 26 may be left in a softer state than the load land 25. In this manner, the valve guide 40 maintains resistance to crushing during installation but also resists fracturing during impact loading.

The guide may be manufactured in a standard manner. In particular, in an embodiment, the stock material for the guide is first annealed to allow easier machining and forming. The part is then machined and finished, after which it is heat-treated, e.g., heated above its austenitic temperature for a period and then appropriately quenched.

INDUSTRIAL APPLICABILITY

The industrial applicability of the improved sealing structure described herein will be readily appreciated from the foregoing discussion. In particular, the disclosed system is applicable to pressurized systems or other systems where fluid or other pressures exert a force on one area of a seal that negatively impacts another area of the seal. Thus, the disclosed system is particularly, though not exclusively, useful in high-pressure and/or high-stress environments.

An exemplary application environment is a diesel fuel delivery system. In these systems, the fuel pressure is extremely high and the cycle rates are also relatively high. For example, the fuel pressure may be 30,000 PSI, with a cycle rate of 1500 cycles per minute for injector check valves bridging the fuel rail to respective injectors. The use of the disclosed improved valve guide in such an environment improves the reliability of check valve seals and other seals so as to minimize maintenance costs and down time for repairs.

It will be appreciated that the foregoing description provides examples of the disclosed system and technique. However, it is contemplated that other implementations of the disclosure may differ in detail from the foregoing examples. All references to the invention or examples thereof are intended to reference the particular example being discussed at that point and are not intended to imply any limitation as to the scope of the invention more generally. All language of distinction and disparagement with respect to certain features is intended to indicate a lack of preference for those features, but not to exclude such from the scope of the invention entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A seal for providing a fluid seal against multiple surfaces, comprising:

a seal body;

a sealing land on the seal body for sealing against a first surface, wherein the first surface is static and positioned to be in sealing contact with the sealing land; and a load land on the seal body for sealing against a second surface, wherein the second surface is movable and positioned to be in repeatable sealing impact with the load land, and the repeatable sealing impact provides a force in a direction that seeks to unseat the sealing land from the first surface.

2. The unitary high pressure seal according to claim 1, wherein the seal body, load land, and sealing land are made of the same material.

3. The unitary high pressure seal according to claim 2, wherein the seal body, load land, and sealing land are formed of alloy steel.

4. The unitary high pressure seal according to claim 3, wherein the seal body, load land, and sealing land are hardened to a Rockwell hardness of between 55 c and 60 c.

5. The unitary high pressure seal according to claim 3, wherein the seal body, load land, and sealing land are differentially hardened.

6. The unitary high pressure seal according to claim 3, wherein the alloy steel is 4150 alloy steel.

7. The unitary high pressure seal according to claim 3, wherein the seal body is threaded.

8. A fuel supply system for a diesel engine comprising:

a fuel pump for providing a pressurized flow of diesel fuel;

at least one fuel rail for receiving pressurized diesel fuel from the fuel pump;

a plurality of fuel injectors for injecting pressurized diesel fuel into respective cylinders of the diesel engine; and a plurality of high-pressure check valves for selectively fluidly linking the fuel rail to respective ones of the plurality of fuel injectors, each high-pressure check valve including a seal having comprising:

a seal body;

a sealing land on the seal body for sealing against a first surface, wherein the first surface is static and positioned to be in sealing contact with the sealing land; and a load land on the seal body for sealing against a second surface, wherein the second surface is movable and positioned to be in repeatable sealing impact with the load land, and the repeatable sealing impact provides a force in a direction that seeks to unseat the sealing land from the first surface.

9. The fuel supply system according to claim 8, wherein the seal body, load land, and sealing land are made of the same material.

10. The fuel supply system according to claim 9, wherein the seal body, load land, and sealing land are formed of alloy steel.

11. The fuel supply system according to claim 10, wherein the seal body, load land, and sealing land are hardened to a Rockwell hardness of between 55 c and 60 c.

12. The fuel supply system according to claim 10, wherein the seal body, load land, and sealing land are differentially hardened.

13. The fuel supply system according to claim 10, wherein the alloy steel is 4150 alloy steel.

14. The fuel supply system according to claim 10, wherein the seal body is threaded.

15. A check valve comprising:

a valve member having a valve stem and a valve head with a sealing surface;

a valve barrel; and a valve guide threaded into the barrel to guide the valve stem, the valve guide further comprising:

valve guide body, a sealing land on the valve guide body in static sealing contact with the valve barrel, and a load land on the valve guide body positioned to be in repeatable sealing impact with the valve head, wherein the repeatable sealing impact provides a force in a direction that seeks to unseat the sealing land from the valve barrel.

16. The injector inlet check valve according to claim 15, wherein one of the load land and sealing land encompasses the other of the load land and sealing land.

17. The injector inlet check valve according to claim 15, wherein the guide body, load land, and sealing land comprise alloy steel.

18. The injector inlet check valve according to claim 17, wherein the guide body, load land, and sealing land are differentially hardened.

19. The injector inlet check valve according to claim 17, wherein the alloy steel is 4150 alloy steel.

20. The injector inlet check valve according to claim 18, wherein the guide body is threaded.

* * * * *

UNITED STATES PATENT AND TRADEMARK OFFICE

CERTIFICATE OF CORRECTION

PATENT NO. : 7,628,140 B2
APPLICATION NO. : 11/863099
DATED : December 8, 2009
INVENTOR(S) : Timur T. Trubnikov It is certified that error appears in the above-identified patent and that said Letters Patent is hereby corrected as shown below:

Title Page, item (74), under "Attorney, Agent, or Firm", in Column 2, Line 1, delete "Ltd;" and insert -- Ltd.; --.

Column 1, line 5, delete "1. TECHNICAL FIELD" and insert -- TECHNICAL FIELD --.

Column 3, line 45, delete "sealing land 25" and insert -- load land 25 --.

Column 1, line 58, delete "surfaces" and insert -- surface --.

Column 2, line 65, delete "four" and insert -- for --.

Column 6, line 33, in Claim 15, delete "valve" and insert -- a valve --.

Signed and Sealed this

Sixteenth Day of March, 2010

David J. Kappos

David J. Kappos
*Director of the United States Patent and Trademark Office*